US006752578B2

(12) United States Patent
Ertel et al.

(10) Patent No.: US 6,752,578 B2
(45) Date of Patent: Jun. 22, 2004

(54) BINDING SHEETS BY ACTIVATING A MICROENCAPSULATED BINDING AGENT

(75) Inventors: John P. Ertel, Portola Valley, CA (US); Akinobu Kuramoto, Pleasanton, CA (US); Robert L. Cobene, Santa Clara, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 09/846,109

(22) Filed: Apr. 30, 2001

(65) Prior Publication Data

US 2002/0159862 A1 Oct. 31, 2002

(51) Int. Cl.[7] ..... B42C 9/00

(52) U.S. Cl. ..... 412/8; 281/15.1; 281/21.1; 281/29; 412/1; 412/9; 412/19; 412/37; 428/41.9

(58) Field of Search ..... 412/1, 4, 6, 8, 412/9, 19, 36, 37, 900, 901; 281/21.1, 40, 15.1, 29, 36, 37; 428/41.9

(56) References Cited

U.S. PATENT DOCUMENTS

| | | | | |
|---|---|---|---|---|
| 4,217,384 A | * | 8/1980 | Schnug | 281/15.1 |
| 4,408,780 A | | 10/1983 | Detterman et al. | |
| 4,744,592 A | * | 5/1988 | Barnette et al. | 281/15.1 |
| 4,801,949 A | * | 1/1989 | Misono et al. | 346/25 |
| 4,865,938 A | | 9/1989 | Sakai et al. | |
| 4,940,852 A | | 7/1990 | Chernack | |
| 4,975,011 A | | 12/1990 | Holmberg | |
| 5,013,200 A | | 5/1991 | Hunder et al. | |
| 5,028,193 A | | 7/1991 | Misicka | |
| 5,052,873 A | * | 10/1991 | Parker et al. | 412/13 |
| 5,193,962 A | * | 3/1993 | Parker et al. | 156/908 |
| 5,350,268 A | | 9/1994 | Muller | |
| 5,437,476 A | | 8/1995 | Hutchinson | |
| 5,531,429 A | | 7/1996 | Clark | |
| 5,532,293 A | | 7/1996 | Landis | |
| 5,735,659 A | * | 4/1998 | Kosasa et al. | 412/11 |
| 5,779,423 A | * | 7/1998 | Bermingham | 281/21.1 |
| 5,827,913 A | | 10/1998 | Baetzold et al. | |
| 6,000,894 A | * | 12/1999 | Suzuki et al. | 270/32 |
| 6,030,163 A | | 2/2000 | Flannery, Jr. | |
| 6,084,010 A | | 7/2000 | Baetzold et al. | |
| 6,193,641 B1 | | 2/2001 | Barker | |
| 6,326,120 B1 | * | 12/2001 | Wang et al. | 430/138 |

FOREIGN PATENT DOCUMENTS

| | | | |
|---|---|---|---|
| DE | 19918473 | * | 11/2000 |
| EP | 0193726 A2 | | 1/1986 |
| EP | 0888907 A1 | | 1/1999 |
| EP | 1057654 A2 | | 12/2000 |
| JP | 11245538 | | 9/1999 |

* cited by examiner

*Primary Examiner*—Monica S. Carter

(57) ABSTRACT

Systems and methods of binding sheets by activating a microencapsulated binding agent are described. Each sheet to be bound has an exposed binding surface region near a spine edge. A frontside adhesive system is disposed over the frontside binding surface region and comprises a binding agent that is encapsulated in a plurality of microcapsules. The adhesive system is non-tacky to enable the sheets to be stacked and individually processed until the binding agent is released from the microcapsules.

19 Claims, 5 Drawing Sheets

BINDING SHEETS BY ACTIVATING A MICROENCAPSULATED BINDING AGENT

TECHNICAL FIELD

This invention relates to systems and methods of binding sheets by activating a microencapsulated binding agent.

BACKGROUND

Today, a variety of different bookbinding systems can deliver professionally bound documents, including books, manuals, publications, annual reports, newsletters, business plans, and brochures. A bookbinding system generally may be classified as a commercial (or trade) bookbinding system that is designed for in-line manufacturing of high quality volume runs or an in-house (or office) bookbinding system designed for short "on-demand" runs. Commercial bookbinding systems generally provide a wide variety of binding capabilities, but require large production runs (e.g., on the order of thousands of bindings) to offset the set-up cost of each production run and to support the necessary investment in expensive in-line production equipment. Office bookbinding systems, on the other hand, generally involve manual intervention and provide relatively few binding capabilities, but are significantly less expensive to set up and operate than commercial bookbinding systems, even for short on-demand production runs of only a few books.

In general, a bookbinding system collects a plurality of sheets (or pages) into a text body (or book block) that includes a spine and two side hinge areas. The bookbinding system applies an adhesive to the text body spine to bind the sheets together. A cover may be attached to the bound text body by applying an adhesive to the side hinge areas or the spine of the text body, or both. The cover of a typical commercial soft cover book generally is attached to the text spine. The covers of hardcover books and some soft cover "lay flat" books, on the other hand, typically are not attached to the text body spines (i.e., the spines are "floating").

Many different systems have been proposed for applying adhesive to a text body spine to bind the text body sheets together.

For example, U.S. Pat. No. 5,346,350 discloses an apparatus for binding sheets that includes an aligning plate that aligns the sheets edges at the spine edge, and two clamping plates that hold the sheets during binding. A heating platen heats and melts a backless solid hot melt adhesive that is placed along the sheet edges. The hot melt adhesive binds the sheets together at the spinal area. The hot melt adhesive also may be used to attach a preformed book cover to the text body spine.

International Patent Publication No. WO 99/38707 discloses a paperback bookbinding scheme in which a cover with an adhesive strip disposed along a spine area is forced between a pair of pressing rollers to form a pocket, and a text body is inserted into the pocket with the text body spine in contact with the adhesive strip. The pressing rollers are moved forcibly toward one another to compress the cover firmly against the front and back sides of the text body and to compress the text body sheets together tightly in the area adjacent to the spine. A sonic tool transmits sonic energy to the cover to activate the adhesive strip and, thereby, bind the text body sheets and the cover into a perfectly bound book.

U.S. Pat. No. 4,911,475 discloses a bookbinding construction in which sheets are bound together into a book block by two or more spaced-apart transverse segments of adhesive.

The front section of a cover is attached to the first page of the book block and the back section of the cover is secured to the last page of the book block. Upon opening the book or turning a page, glue-free portions of the spine edge of the open page flex or bow outward over the facing page in a wedging manner or interfering fit. According to the '475 patent, this wedging action against the opposite page resists the tendency of the book to spring closed and forces the pages of the book to lie flat.

U.S. Pat. No. 5,271,794 discloses an adhesive applicator that is configured to spread coat an adhesive onto the spine and side edges of a text body to bind the text body sheets and a cover into a perfectly bound book with an attached spine. The adhesive applicator includes a book spine coating nozzle with adjustable side sealing jaws for adjusting the nozzle width for different book thicknesses and separate side glue outlets for depositing glue on the book sides. Glue flow control valves are disposed between the spine coating nozzle and the side glue outlets so the glue deposited on the book sides may be selectively and independently cut off or controlled.

Adhesive systems that use activatable microcapsules also have been proposed.

For example, U.S. Pat. No. 4,940,852 discloses a pressure sensitive adhesive system that includes a curable adhesive mixed with a plurality of rupturable microcapsules filled with a curing agent.

U.S. Pat. No. 5,532,293 discloses an adhesive system for tamper-evident envelopes. The adhesive system includes a dried cohesive latex containing gelatin and a plurality of solvent-filled microcapsules. Upon application of pressure, the microcapsules are ruptured, whereby the solvent is released to dissolve the cohesive material and form a bond.

U.S. Pat. No. 6,084,010 discloses a hot melt adhesive composition that includes at least one ingredient present in an encapsulated form. The encapsulated ingredient may be any known hot melt adhesive formulation ingredient as well as any hot melt adhesive additive such as antioxidants and fragrances for which there is a desirable change in adhesive properties by isolating such ingredient for a duration of time. The encapsulated ingredient is released from the shell by means of pressure, temperature, diffusion, pH, light, radiation, ultrasound, and combinations thereof.

Still other adhesive systems that include activatable microcapsules have been proposed.

SUMMARY

The invention features novel systems and methods of binding sheets by activating a microencapsulated binding agent.

In one aspect of the invention, each sheet to be bound has an exposed frontside binding surface region near a spine edge. A frontside adhesive system is disposed over the frontside binding surface region and comprises a binding agent that is encapsulated in a plurality of microcapsules. The adhesive system is non-tacky to enable the sheets to be stacked and individually processed until the binding agent is released from the microcapsules.

Embodiments in accordance with this aspect of the invention may include one or more of the following features.

In some embodiments, each sheet has an exposed backside binding surface region near the spine edge and a backside adhesive system disposed over the backside binding surface region. The frontside adhesive system may have the same or different composition as the backside adhesive system. In one embodiment, the frontside adhesive system comprises a main component of a two-part epoxy resin system and the backside adhesive system comprises a curing agent of the two-part epoxy resin system. The frontside binding surface region and the backside binding surface region may be located on the same side or on opposite sides of each sheet. In embodiments with frontside and backside binding surfaces located on the same sheet side, each sheet may be scored along a fold line disposed between the frontside binding surface region and the backside binding surface region.

As used herein, the terms "frontside" and "backside" are intended merely to distinguish one side of a sheet from the opposite side. These terms are not intended to indicate any particular absolute sheet orientation or position.

The binding agent may comprise an adhesive composition. Alternatively, the frontside adhesive system may comprise a non-tacky adhesive and the binding agent may comprise an adhesive activator. In some embodiments, the frontside adhesive system comprises first and second binding agents each encapsulated in a respective plurality of microcapsules, wherein the first binding agent comprises a main component of a two-part epoxy resin system and the second binding agent comprises a curing component of the two-part epoxy resin system.

The binding agent may be released from the microcapsules by exposure to radiation.

In some embodiments, the frontside adhesive system has a machine-readable characteristic from which information may be extracted automatically. The machine-readable characteristic may be indicative of sheet type or adhesive type, or both.

In another aspect, the invention features a bookbinding system that includes a sheet collector that is configured to form a text body from a plurality of the above-described sheets, and an adhesive activator that is configured to activate the adhesive system of each sheet to form a bound text body.

Embodiments in accordance with this aspect of the invention may include one or more of the following features.

The adhesive activator may be configured to activate the adhesive system of each sheet of the text body by applying radiation to the encapsulated binding agent. For example, the adhesive activator may include a microwave cavity that is configured to receive a spine end of the text body and apply microwave energy to the encapsulated binding agent of each sheet.

The bookbinding system also may include a sensor that is configured to extract information from a machine-readable characteristic of the adhesive system. For example, the sensor may be configured to interrogate a radiation response characteristic of the adhesive system.

The invention also features a method of binding the above-described sheets into a bound text body by activating the adhesive system of each sheet.

Other features and advantages of the invention will become apparent from the following description, including the drawings and the claims.

DETAILED DESCRIPTION

In the following description, like reference numbers are used to identify like elements. Furthermore, the drawings are intended to illustrate major features of exemplary embodiments in a diagrammatic manner. The drawings are not intended to depict every feature of actual embodiments nor relative dimensions of the depicted elements, and are not drawn to scale.

Figure 1:
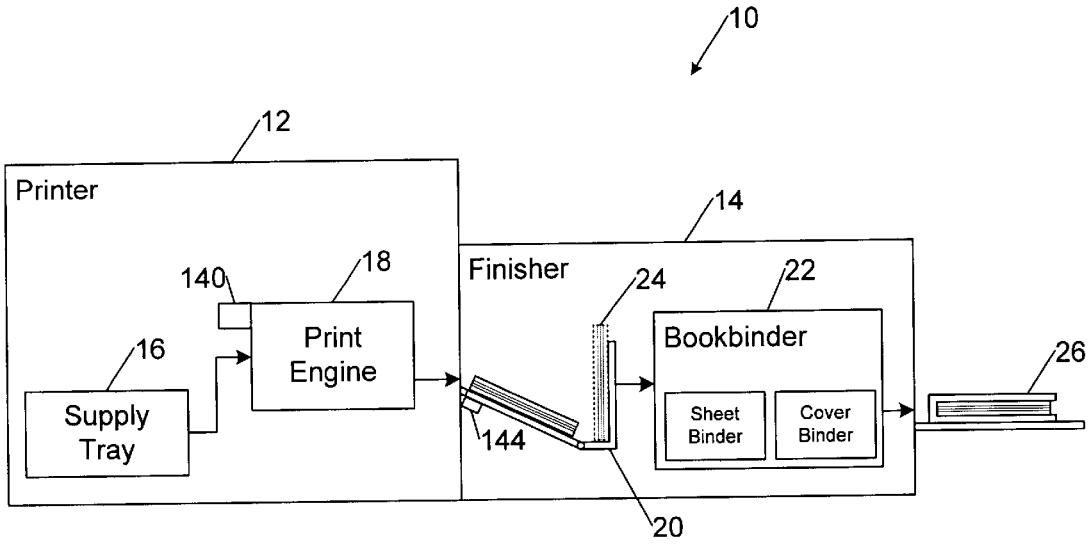
FIG. 1 is a diagrammatic side view of a bookbinding system.

Referring to FIG. 1, in one embodiment, a bookbinding system 10 includes a printer 12 and a finisher 14. Bookbinding system 10 may be implemented as a desktop or office bookmaking system designed to satisfy on-demand bookbinding needs. Printer 12 may be a conventional printer (e.g., a LaserJet® printer available from Hewlett-Packard Company of Palo Alto, Calif., U.S.A.) that includes a supply tray 16 that is configured to hold a plurality of sheets (e.g., paper sheets), and a print engine 18 that is configured to apply markings onto the sheets received from supply tray 16. Finisher 14 includes a sheet collector 20 and a bookbinder 22. Bookbinder 22 includes a sheet binder that is configured to bind the text body sheets to one another, and a cover binder that is configured to attach a cover to the bound text body. In operation, sheets are fed from supply tray 16 to print engine 18, which prints text, pictures, graphics, images and other patterns onto the sheets. The printed sheets are fed to sheet collector 20, which collects and aligns the sheets into a text body 24 with an exposed spine bounded by two exposed side hinge areas. The text body 24 is conveyed to bookbinder 22. The sheet binder binds the sheets of text body 24, and the cover binder attaches a cover to the bound text body to produce a bound book 26 with a floating spine or an attached spine.

Figure 2A:
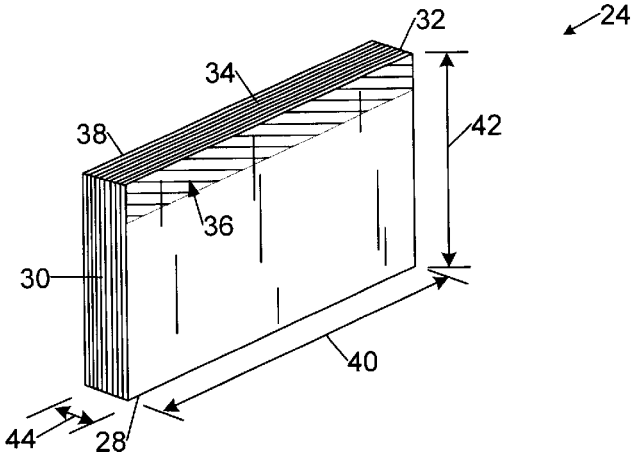
FIG. 2A is a diagrammatic perspective view of a text body formed by collecting and aligning a plurality of sheets.
Figure 2B:
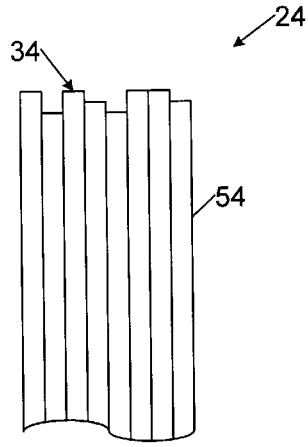
FIG. 2B is a diagrammatic end view of the spinal portion of a text body formed by registering sheets with respect to two datum edges so that variations in sheet width dimension are accommodated in the spine edge of the text body.

Referring to FIGS. 2A and 2B, text body 24 includes a plurality of sheets and is characterized by a front end 28, two sides 30, 32 and a spinal area (or spine) 34, which is located opposite to front end 28. Spine 34 is bounded by two side hinge areas 36, 38. Text body 24 may be characterized by a height dimension 40, a width dimension 42, and a thickness dimension 44. As shown in FIG. 2B, the text body sheets 54 are registered and aligned with respect to two datum edges. In particular, sheets 54 preferably are aligned with reference to front end 28 of text body 24 and one of the two text body sides 30, 32 so that variations in sheet dimensions are accommodated in the text body width dimension 42 of spinal area 34. As a result, the exposed front end 28 of text body 24 will present a clean finished look after the text body has been bound and a cover has been attached to the bound text body.

Figure 3:
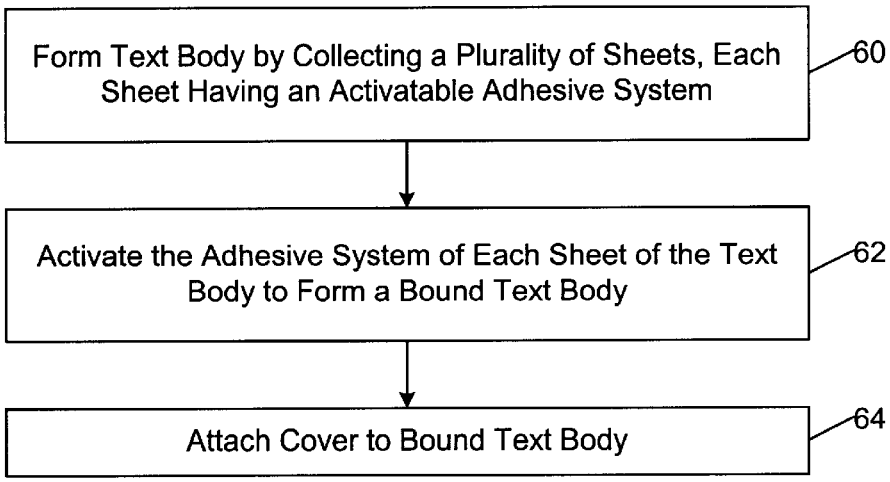
FIG. 3 is a flow diagram of a method of binding sheets into a bound text body.

Referring to FIG. 3, in one sheet binding embodiment, text body 24 may be bound as follows. Text body 24 is formed by collecting a plurality of sheets, each sheet having a pre-applied, activatable adhesive system (step 60). The adhesive system of each sheet is activated to form a bound text body (step 62). Next, a cover is attached to the bound text body to form a bound book with a floating spine or an attached spine (step 64).

As explained above, the text body sheets are bound together by activating a pre-applied microencapsulated binding agent. In particular, each sheet has at least one binding surface region near the spine edge of the sheet. An adhesive system that includes a binding agent encapsulated in a plurality of microcapsules is disposed over the binding surface region. In accordance with this approach, there are no adhesive consumables generated during the bookbinding process. In addition, placement of the adhesive system in a surface region near the spine edge allows the text body sheets to be bound together with lap joints—rather than butt joints, which typically are found in books bound by common bookbinding methods. The relatively large bonded surface area between adjacent sheets provides a strong binding in the resulting bound text body.

In preferred embodiments, the activatable adhesive system is applied to each text body sheet beforehand, whereby each sheet that is loaded into supply tray 16 of bookbinding system 10 includes an activatable adhesive system. Before being activated, the activatable adhesive system is non-tacky to enable the sheets to be stacked and individually processed through bookbinding system 10 until the binding agent is released from the microcapsules by an adhesive activator that is located in the sheet binder module.

A wide variety of different kinds of adhesive systems may be used to bind the sheets into a bound text body. For example, in some embodiments, the adhesive system may consist of an adhesive (e.g., a conventional hot melt adhesive) that is encapsulated in a plurality of rupturable microcapsules. In other embodiments, the adhesive system may consist of a non-tacky curable adhesive and a curing agent encapsulated in a plurality of rupturable microcapsules. In one embodiment, the adhesive system may consist of a cohesive material (e.g., a rubber latex) dispersed in a non-adhesive material (e.g., a continuous phase film former, such as gelatin, starch, water-soluble gums, polyvinyl pyrolidone, alginates, and polyvinyl alcohol) and a microencapsulated solvent for dissolving and, thereby, rendering the cohesive material adherent. In still other embodiments, the adhesive system may consist of a main component of a conventional two-part epoxy resin system and curing agent component of the epoxy resin system. In these embodiments, the main component or the curing agent, or both, may be encapsulated in rupturable microcapsules.

The binding agent (e.g., adhesive, main epoxy component, curing agent epoxy component, or solvent) may be microencapsulated by a conventional microencapsulation process, including coacervation, interfacial polymerization and condensation, air suspension, centrifugal extrusion, spray drying, pan coating, and application of pressure shock wave to a dispersion of core and shell material in a liquid carrier medium (see, e.g., U.S. Pat. No. 5,271,881). The material composition and wall thickness of the microcapsule shell are selected so that the microcapsule shells will not rupture as a sheet is being processed through bookbinding system 10 until the adhesive system purposefully is activated by the adhesive activator. The microcapsule wall material may be formed from, for example, gelatin, ureaformaldehyde, melamineformaldehyde, polyurea, and polyureaurethane.

Figure 4A:
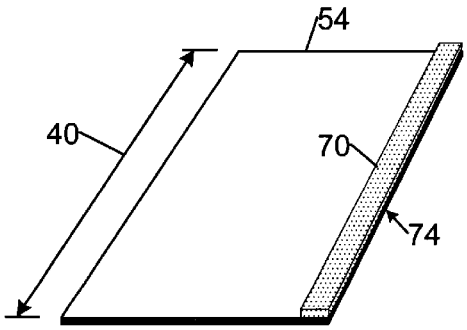
FIG. 4A is a diagrammatic perspective view of a text body sheet with an activatable adhesive system disposed over a frontside binding surface region.
Figure 4B:
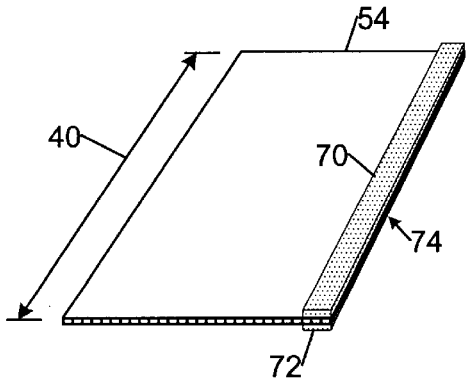
FIG. 4B is a diagrammatic perspective view of a text body sheet with an activatable adhesive system disposed over a frontside binding surface region and an activatable adhesive system disposed over a backside binding surface region.

Referring to FIGS. 4A and 4B, in some embodiments, a frontside adhesive system 70 may be applied to a binding surface region on one side of a text body sheet 54 (FIG. 4A). In other embodiments, a second, backside adhesive system 72 may be applied to a binding surface region on the opposite side of text body sheet 54. The binding surface regions are located near a spine edge 74 of text body sheet 54. Each binding surface region preferably has a length that corresponds to height dimension 40 of sheet 54 and a width that is on the order of about 0.5–1.0 mm. In the embodiments of FIG. 4B, the frontside adhesive system 70 may correspond to the main component of a two-part epoxy resin system and the backside adhesive system 72 may correspond to the curing component of the epoxy resin system. In these embodiments, the text body sheets may be stacked to form a text body 24 with the frontside adhesive system 70 of one sheet positioned in contact with the backside adhesive system 72 of an adjacent sheet. In this way, upon activation, the curing agent of one sheet may react with and cure the main epoxy component of an adjacent sheet, whereby a text body with a strong binding may be formed.

Figure 5A:
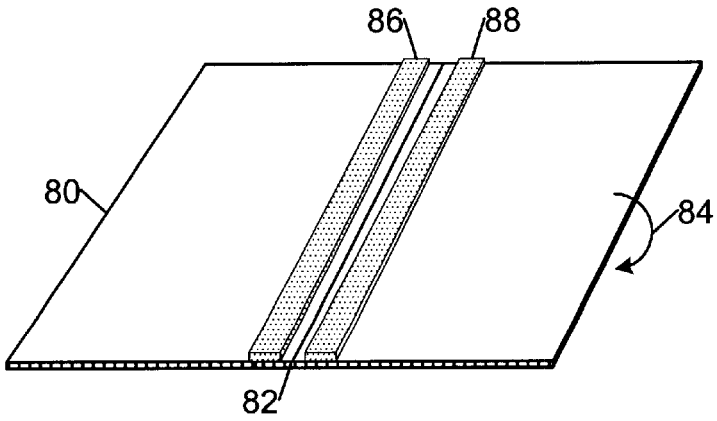
FIG. 5A is a diagrammatic perspective view of a text body sheet having a frontside binding surface region and a backside binding surface region separated by a fold line and located on the same side of the text body sheet.
Figure 5B:
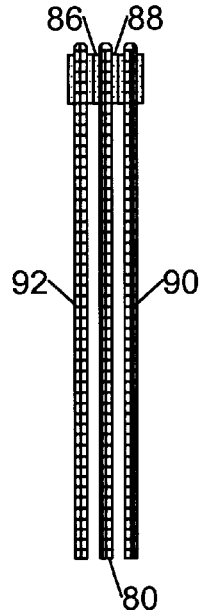
FIG. 5B is a diagrammatic perspective view of the text body sheet of FIG. 5A folded along the fold line and disposed between a pair of similarly folded text body sheets.

As shown in FIGS. 5A and 5B, in some embodiments, front and backside binding surface regions are located on the same side of a text body sheet 80 that is configured to be folded along a fold line 82. Text body sheet 80 preferably is scored along a fold line 82 to allow text body sheet 80 preferentially to fold in the direction of arrow 84, whereby frontside and backside adhesive systems 86, 88 may be exposed for contact with the complementary adhesive systems of adjacent, folded text body sheets 90, 92 (FIG. 5B).

As explained above, the microcapsules encapsulating the binding agent preferably are sufficiently pressure-resistant and temperature-resistant that they do not rupture when exposed to the temperature and pressure conditions of bookbinding system 10. Accordingly, the microcapsules should withstand sheet roller pressure and temperature conditions that typically are applied to sheets processed in conventional inkjet and LaserJet® printing systems. The encapsulated binding agent, however, preferably is released from the microcapsules upon exposure to radiant energy (e.g., microwave radiation). The properties of the activating radiation are selected so that the radiation is absorbed by the binding agent. Upon exposure to the activating radiation, the binding agent may undergo a thermal expansion or a phase change (e.g., from liquid phase to gas phase) that increases the internal pressure within the microcapsules to a level that is sufficient to rupture the microcapsules and, thereby, release the binding agent.

Figure 6:
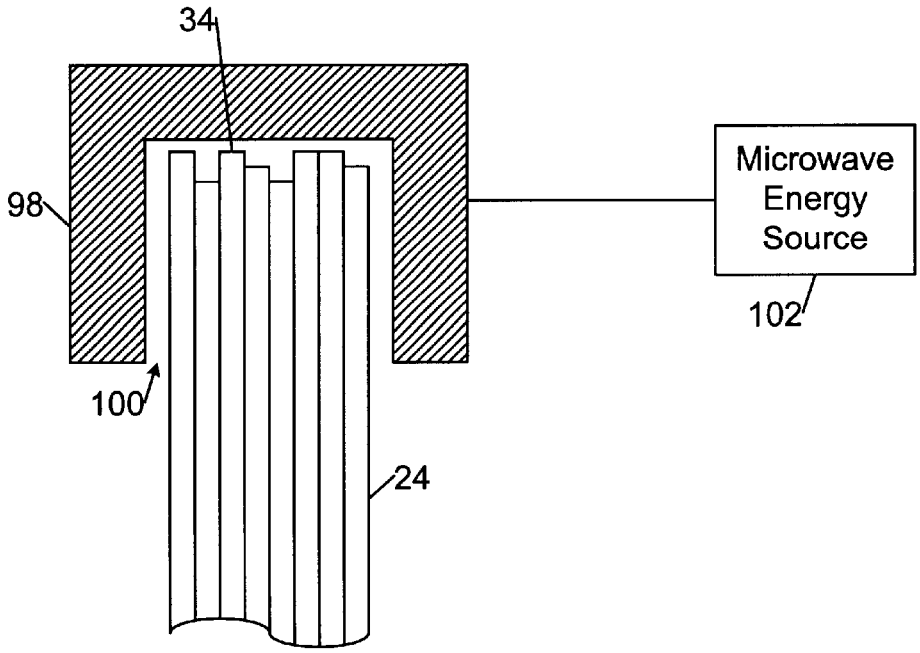
FIG. 6 is a diagrammatic perspective view of an adhesive activator applying microwave radiation to the spinal end of a text body to activate the adhesive system of each text body sheet.

Referring to FIG. 6, in one embodiment, the sheet binder of bookbinder 22 includes an adhesive activator 98 with a microwave cavity 100 that is configured to receive spine end 34 of text body 24 and to apply microwave energy to the encapsulated binding agent disposed over the one or more binding surface regions of each sheet of text body 24. Upon exposure to the microwave energy, the microcapsules rupture to release the binding agent and, thereby, activate the adhesive system of each text body sheet to produce a bound text body. The microwave energy may be supplied by a conventional microwave energy source 102.

As explained above, the resulting bound text body has a binding strength that is greater than many conventionally bound texts because the text body sheets are bound by lap joints, as opposed to the more common butt joints produced by applying an adhesive to the spine edges of the sheets.

A cover may be attached to the resulting bound text body as follows.

Figure 7A:
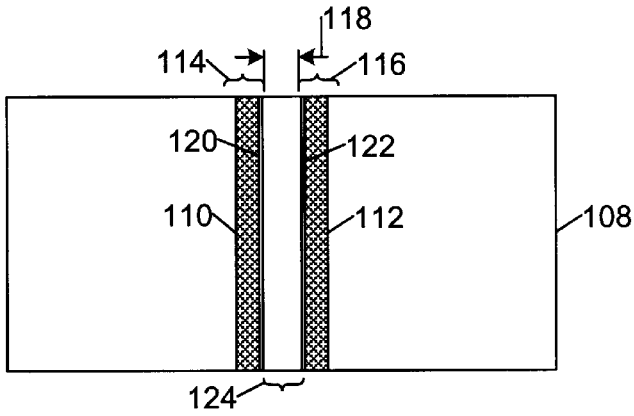
FIG. 7A is a diagrammatic front view of a cover with two strips of pressure sensitive adhesive applied to areas corresponding to the side hinge areas of a bound text body.
Figure 7B:
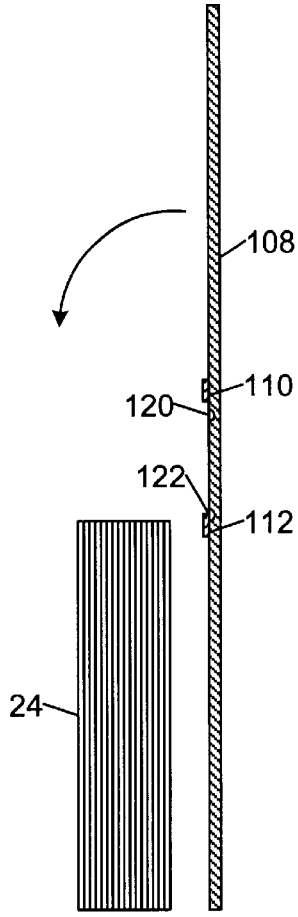
FIG. 7B is a diagrammatic end view of the cover of FIG. 7A being folded over the bound text body of FIG. 7A.
Figure 7C:
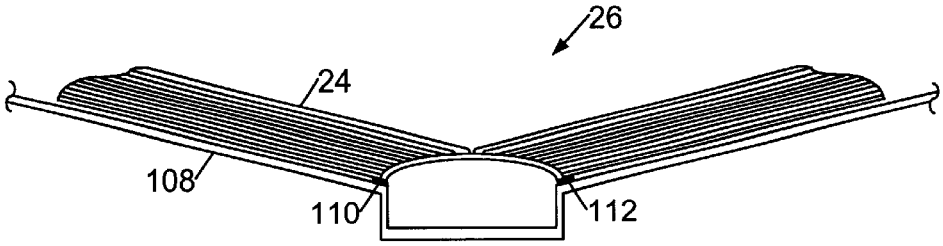
FIG. 7C is a diagrammatic end view of an open bound book with a floating spine formed by attaching the cover of FIG. 7A to the bound text body of FIG. 7A.

Referring to FIGS. 7A–7C, in one embodiment, a solid pressure sensitive adhesive film is applied to a cover 108 as two strips 110, 112 in cover areas 114, 116 that correspond to side hinge areas 36, 38 of text body 24. Pressure sensitive adhesive strips 110, 112 are spaced apart by a width dimension 118 that is at least as wide as the thickness dimension 44 of text body spine 34. As shown in FIG. 7B, cover 108 is aligned with respect to the same datum edges used to align the sheets of text body 24, cut to size, and folded over the bound text body 24. Cover 108 preferably is scored along a pair of score lines 120, 122 to allow cover 108 preferentially to fold over spinal area 34 of text body 24. Pressure is applied to cover areas 114, 116 to activate pressure sensitive adhesive strips 110, 112 and, thereby, attach cover 108 to text body 24. As shown in FIG. 7C, the resulting perfectly bound book 26 has a floating spine that enables the book 26 to lay flat when opened.

Figure 8:
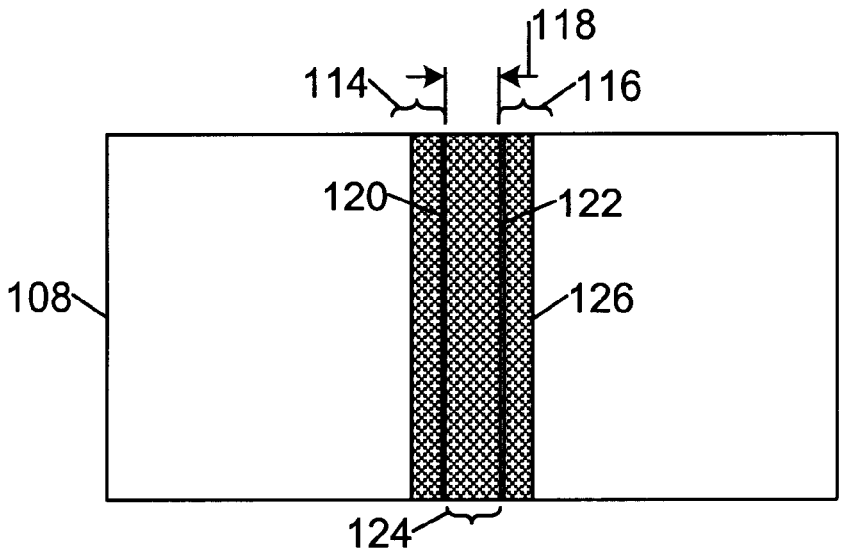
FIG. 8 is a diagrammatic front view of a cover with a single strip of pressure sensitive adhesive applied to an area corresponding to the spine and side hinge areas of a bound text body.
Figure 9:
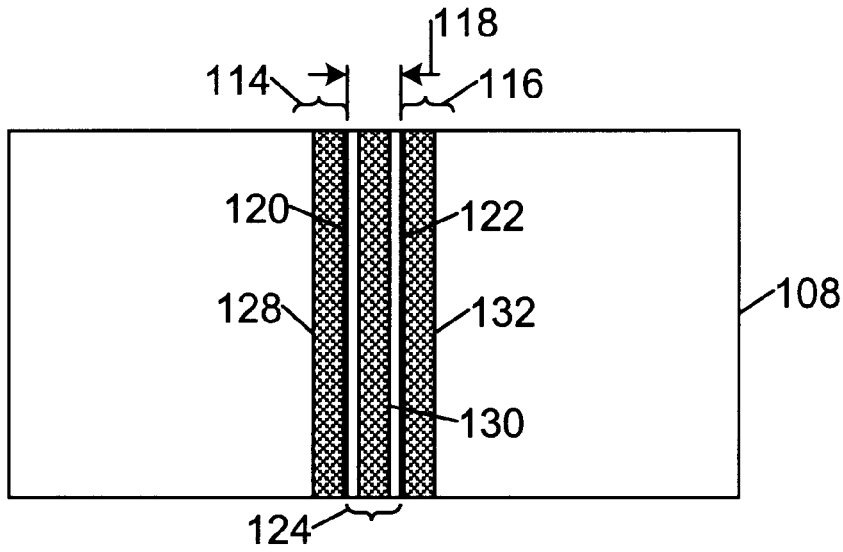
FIG. 9 is a diagrammatic front view of a cover with multiple strips of pressure sensitive adhesive applied to an area corresponding to the spine and side hinge areas of a bound text body.

As shown in FIGS. 8 and 9, text body 24 may be bound to cover 108 with an attached spine construction by applying a solid pressure sensitive adhesive film to a cover area 124 that corresponds to text body spine 34. The solid pressure sensitive adhesive film may be applied as a single continuous strip 126 over cover areas 114, 116, and 124 (FIG. 8), or in a series of multiple strips 128, 130, 132 over cover areas 114, 116, and 124 (FIG. 9).

As used herein, "pressure sensitive adhesives" refer to a class of adhesive compositions that are applied with pressure and generally do not undergo a liquid to solid transition in order to hold materials together. Pressure sensitive adhesives may be solvent-free natural or synthetic resins characterized by the rapid wetting of a surface region to form an adhesive bond upon contact with the surface region under pressure.

Other embodiments are within the scope of the claims.

For example, the adhesive system may include a machine-readable characteristic from which information may be extracted automatically. In some embodiments, the machine-readable characteristic may correspond to a radiation absorptive or reflective property that may be detected by a conventional optical sensor, which may include a transmitter and a receiver. The characteristic radiation response of the adhesive system may occur within a particular wavelength range (e.g., wavelengths in the ultraviolet range, the infrared range or the optical light range). The characteristic radiation response of the adhesive system may correspond to the radiation response properties of the constituent adhesive materials or to a non-adhesive material component that is added to produce a desired radiation response.

The machine-readable characteristic may be used to indicate the orientation (e.g., frontside-up or backside-up) of each sheet as it is processed through bookbinding system 10. For example, referring back to FIG. 1, printer 12 may include a sensor 140 that is configured to detect the machine-readable characteristic of each sheet to confirm that the sheets are oriented properly before printing. In addition, sheet collector 20 may include a sensor 144 that is configured to detect the machine-readable characteristic of each sheet to confirm that the sheets are stacked properly. For example, the frontside adhesive system of one sheet may be positioned in contact with the backside adhesive system of an adjacent sheet when the frontside and backside adhesive systems correspond to complementary components of a two-part epoxy resin system. The machine-readable characteristic also may be sensed by bookbinding system 10 to extract other information, such as adhesive system type information or sheet type information (e.g., size or format). This information may be used, for example, by printer 12 to select a printing algorithm that is tailored appropriately for the type of sheet stock that is loaded into supply tray 16.

Still other embodiments are within the scope of the claims.

What is claimed is:

1. A system for binding sheets into a bound text body, comprising:

a plurality of sheets, each sheet having an exposed frontside binding surface region near a spine edge, a frontside adhesive system disposed over the frontside binding surface region and comprising a binding agent encapsulated in a plurality of microcapsules, an exposed backside binding surface region near the spine edge, and a backside adhesive system disposed over the backside binding surface region, wherein the frontside adhesive system and the backside adhesive system are non-tacky to enable the sheets to be stacked and individually processed until the binding agent is released from the microcapsules, and the frontside adhesive system has a different composition than the backside adhesive system.

2. The system of claim 1, wherein the frontside adhesive system comprises a main component of a two-part epoxy resin system and the backside adhesive system comprises a curing agent of the two-part epoxy resin system.

3. The system of claim 1, wherein the frontside binding surface region and the backside binding surface region are located on opposite sides of each sheet.

4. The system of claim 1, wherein the frontside binding surface region and the backside binding surface region are located on the same side of each sheet.

5. The system of claim 4, wherein each sheet is scored along a fold line disposed between the frontside binding surface region and the backside binding surface region.

6. The system of claim 1, wherein the binding agent comprises an adhesive composition.

7. The system of claim 1, wherein the frontside adhesive system comprises a non-tacky adhesive and the binding agent is an adhesive activator configured to activate the non-tacky adhesive.

8. The system of claim 1, wherein the frontside adhesive system comprises first and second binding agents each encapsulated in a respective plurality of microcapsules, the first binding agent comprises a main component of a two-part epoxy resin system and the second binding agent comprises a curing component of the two-part epoxy resin system.

9. The system of claim 1, wherein the binding agent is releasable from the microcapsules by exposure to radiation.

10. The system of claim 1, wherein the frontside adhesive system has a machine-readable characteristic from which at least one of sheet type information and adhesive type information is automatically extractable, and further comprising a sensor configured to extract at least one of sheet type information and adhesive type information from the machine-readable characteristic.

11. The system of claim 1, wherein the frontside binding surface regions of different sheets are substantially identical to each other.

12. The system of claim 1, further comprising a supply tray containing the plurality of sheets, and a sheet binder configured to bind sheets received from the supply tray into a bound text body.

13. The system of claim 2, wherein the frontside adhesive system is substantially free of the curing agent and the backside adhesive system is substantially free of the main component of the two-part epoxy resin system.

14. A system for binding sheets into a bound text body, comprising:

a plurality of sheets, each sheet having an exposed frontside binding surface region near a spine edge and a frontside adhesive system disposed over the frontside binding surface region and comprising a binding agent encapsulated in a plurality of microcapsules, wherein the frontside adhesive system is non-tacky to enable the sheets to be stacked and individually processed until the binding agent is released from the microcapsules and the frontside adhesive system has a machine-readable characteristic indicative of sheet type; and a sensor configured to extract sheet type information from the machine-readable characteristic.

15. The system of claim 14, further comprising a printer configured to select a printing algorithm based on the machine-readable characteristic detected by the sensor.

16. A system for binding sheets into a bound text body, comprising:

a sheet collector configured to form a text body from a plurality of sheets, each sheet having an exposed binding surface region near a spine edge and an adhesive system disposed over the binding surface region and comprising a binding agent encapsulated in a plurality of microcapsules, the adhesive system being non-tacky to enable the sheets to be stacked and individually processed until the binding agent is released from the microcapsules;

an adhesive activator configured to activate the adhesive system of each sheet of the text body to form a bound text body; and a sensor configured to extract sheet type information or adhesive type information, or both, from a machine-readable characteristic of the adhesive system.

17. The system of claim 16, wherein the sensor is configured to interrogate a radiation response characteristic of the adhesive system.

18. A method of binding sheets into a bound text body, comprising:

forming a text body from a plurality of sheets, each sheet having an exposed binding surface region near a spine edge and an adhesive system disposed over the binding surface region and comprising a binding agent encapsulated in a plurality of microcapsules, the adhesive system being non-tacky to enable the sheets to be stacked and individually processed until the binding agent is released from the microcapsules;

activating the adhesive system of each sheet of the text body to form a bound text body; and extracting sheet type information or adhesive type information, or both, based on a machine-readable characteristic of the adhesive system of each sheet.

19. The method of claim 18, wherein the binding surface regions of different sheets are substantially identical to each other.

* * * * *